United States Patent [19]

Foshee

[11] Patent Number: 4,572,556

[45] Date of Patent: Feb. 25, 1986

[54] MORTISE LOCK

[75] Inventor: William R. Foshee, Indianapolis, Ind.

[73] Assignee: Best Lock Corporation, Indianapolis, Ind.

[21] Appl. No.: 544,630

[22] Filed: Oct. 24, 1983

[51] Int. Cl.[4] ..... E05C 1/12

[52] U.S. Cl. ..... 292/165; 70/107; 70/467

[58] Field of Search ..... 70/107, 144, 150, 152, 70/467; 292/165, 169, 169.13–169.15, 169.17, DIG. 57

[56] References Cited

U.S. PATENT DOCUMENTS

| | | | |
|---|---|---|---|
| 602,886 | 4/1898 | Voight | 292/165 |
| 697,599 | 4/1902 | Barrett | 70/150 |
| 943,143 | 12/1909 | Draper | 292/165 |
| 1,124,992 | 1/1915 | Bennett . | |
| 1,372,276 | 3/1921 | Carlson | 292/165 X |
| 1,473,378 | 11/1923 | Moore | 292/165 |
| 1,554,839 | 9/1925 | Brown | 70/150 |
| 1,900,328 | 3/1933 | Boggs . | |
| 2,065,291 | 12/1936 | Ritterbusch | 70/150 |
| 2,086,982 | 7/1937 | McCarter | 70/146 |
| 3,361,462 | 1/1968 | Foster | 292/165 |
| 3,672,714 | 6/1972 | Schultz | 292/34 |
| 3,750,433 | 8/1973 | Sanders | 292/165 X |
| 4,118,056 | 10/1978 | Alexander | 292/169 |
| 4,389,061 | 6/1983 | Foshee | 292/169 |

OTHER PUBLICATIONS

"Arrow" Mortise Lock.

*Primary Examiner*—Kenneth J. Dorner
*Assistant Examiner*—Lloyd A. Gall
*Attorney, Agent, or Firm*—Barnes & Thornburg

[57] ABSTRACT

An improved mortise lock includes a case, a latch bolt including a tailpiece, and a retraction lever for retracting the latch bolt. The retraction lever includes a nose portion in engagement with the tailpiece to define a tailpiece contact point, a pivot portion pivotally mounted on a pivot in the case, and a mid-portion intermediate the nose and pivot portions. The mid-portion includes spaced apart side walls defining a yoke. Inside and outside operating hubs are mounted in the case for independent rotation and are aligned in coaxial relation. Each operating hub is rotatable in at least one direction toward a rotated position and is formed to include a hub camming surface. The mortise lock further includes a cam follower for riding on the hub camming surfaces during rotation of the hubs to cause the retraction lever to pivot and retract the latch bolt in response to rotation of either the inside or outside operating hub. The cam follower includes a roller and a shaft for rotatably supporting the roller in the yoke to engage the hub camming surface to define a floating hub contact point. The tailpiece and hub contact points cooperate to define an effective lever arm of substantially constant dimension therebetween irrespective of the direction of hub rotation.

10 Claims, 4 Drawing Figures

MORTISE LOCK

The invention relates to a mortise lock, and particularly to a mortise lock in which operation of the handle requires a low torque which is substantially the same for both directions of rotation.

BACKGROUND OF THE INVENTION

Typically, the handle or knob of a mortise lock has been connected to rotate a hub which carries opposite arms or cams which move against a retraction lever for retracting the latch bolt. In early cases, the opposite arms or cams engaged the retraction lever at widely separated points so that the lever arms were quite different for different directions of knob rotation, and in consequence, the torque required was much greater for one direction of rotation than for the other. An example of this is shown by the McCarter U.S. Pat. No. 2,086,982 of July 13, 1937. One proposal for reducing this torque difference has been to utilize a so-called scissors lever arrangement in which rotation of the knob hub in one direction acts directly on the retraction lever while rotation in the opposite direction acts on a secondary lever pivotally interconnected to the retraction lever. This does not completely eliminate the torque difference, and is relatively complicated and expensive. Examples of this are shown in Foster U.S. Pat. No. 3,361,462 of Jan. 2, 1968, and in FIGS. 2–5 of my U.S. Pat. No. 4,389,061 of June 21, 1983. Still another proposal has been to interpose a slide between the hub and retraction levers so that rotation of the knob hub in either direction produces linear movement of the slide which is transmitted to the lever at substantially the same point for both directions of knob rotation. This interposes additional mechanism and additional cost. An example of this is shown in the Alexander U.S. Pat. No. 4,118,056 of Oct. 3, 1978.

The present invention provides for the retraction of the latch bolt of a mortise lock by the application of a relatively low torque on the knob or handle, which torque is substantially the same for both directions of rotation of the knob or handle.

SUMMARY OF THE INVENTION

In accordance with the present invention, the latch bolt of a mortise lock, including its tailpiece, is slidably mounted between the front and the rear side walls of the lock case and biased to projected position through the edge face which is mounted at the edge of the door. A knob hub, or as is customary, inside and outside knob hubs are rotatably mounted coaxially in the case and operable respectively by the inside and outside handles or knobs. A retraction lever extends from a pivot in the case past the hub or hubs and into retracting engagement with the tailpiece of the latch bolt. Each hub includes a cam flange formed with a heart-shaped cam surface including a central cam valley and opposite cam faces spiralling out from such valley in opposite directions. When two hubs are present, their flanges lie adjacent and parallel to each other. The retraction lever is formed with a yoke open toward such cam flanges, and a cam follower roller or roller means is rotatably mounted in such yoke by means of a relatively small roller shaft received in bores in the side walls of the yoke. The roller is normally engaged in the cam valleys of the hub flanges, and the oppositely extending spiral cam faces are operable, on rotation of a knob hub, to cam the roller or roller means in a direction to pivot the retraction lever rearward so as to retract the latch bolt. The force exerted on the lever by such roller or roller means is transmitted to the lever through the relatively small roller shaft so as to be exerted at substantially the same point along the length of such lever in response to hub rotation in either direction. The lever arm is thus substantially the same whichever direction of rotation is applied, and the opposite cam faces, being symmetrical, require substantially the same torque for either direction of rotation. In accordance with the present invention, when two hubs are present, the roller means preferably comprises a single roller which engages the cam flanges of both.

The accompanying drawings illustrate the invention and show a preferred embodiment exemplifying the best mode of carrying out the invention as presently perceived. In such drawings:

DETAILED DESCRIPTION OF THE DRAWING

Figure 1:
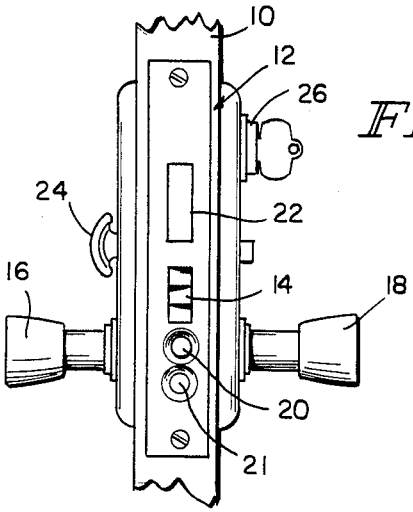
FIG. 1 is an edge elevation of a door fitted with a mortise lock.

The lock mechanism shown in the drawings comprises a mortise lock having a generally rectangular case mounted in a cavity in the edge of a door 10 with its edge face 12 exposed at such edge. The lock has a latch bolt 14 which is always operable by an inside knob 16 and is operable by an outside knob 18 when the stopwork buttons 20 and 21 are in the position shown in FIG. 2. By reversing the positions of such stopwork buttons 20 and 21, the outside knob 18 is locked against rotation so that it is inoperable to retract the latch bolt 14.

The lock also has a dead bolt 22 which is operable from the inside of the door by a thumbturn 24, and the lock includes a key-operated mechanism 26 which is effective both to retract the dead bolt 22 and to retract the latch bolt 14 when the outside knob 18 is inoperable. The dead bolt 22 and key-operated mechanism may be of any conventional sort and form no part of the present invention.

Figure 2:
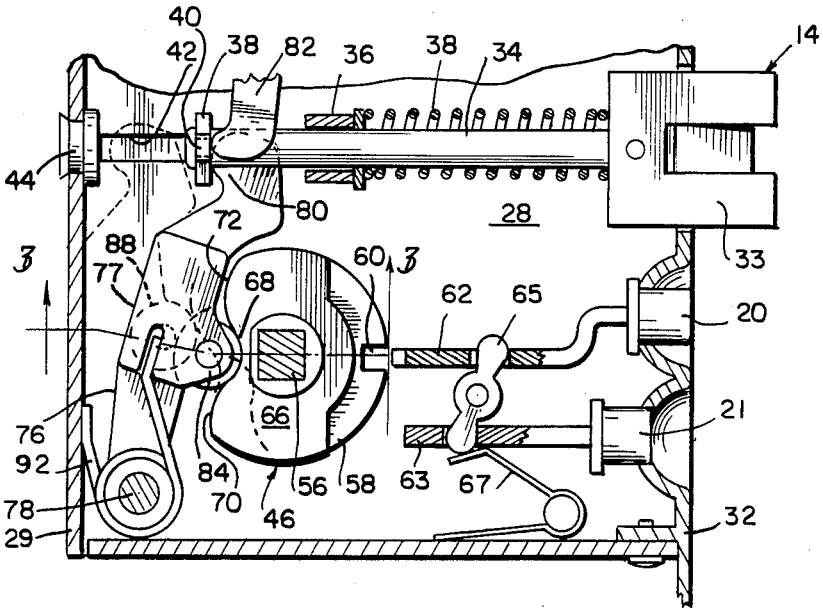
FIG. 2 is a longitudinal vertical section showing the latch bolt of the mortise lock and mechanism in accordance with the present invention for retracting such latch bolt.
Figure 3:
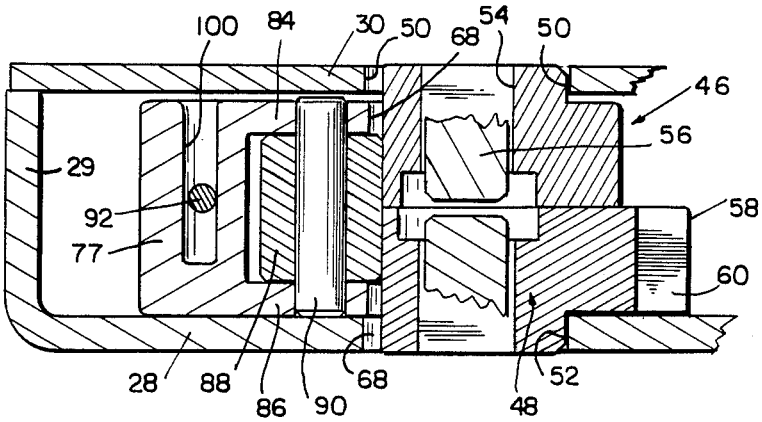
FIG. 3 is a horizontal section on the line 3—3 of FIG. 2.

As shown in FIGS. 2 and 3, the box-like mortise lock case comprises a bottom or back wall 28 and a cover or front wall 30 interconnected by a rear edge wall 29 and by a front edge face member 32 fixed by screws to the top and bottom edge walls of the rectangular case. The latch bolt 14 projects through the face member 32 and has a tailpiece 34 extending rearward from the head 33 of the bolt through a reaction collar 36 fixed between the front and back walls of the case. The tailpiece is surrounded by a biasing spring 38 which acts between the head of the bolt and the reaction collar 36. The tailpiece extends therebeyond and carries a tail plate 38 at its rear end. The tail plate has laterally extending ears 40 which ride in slots 42 in the front and rear walls 28 and 30 of the case, and the rear edge wall of the case carries a stopbutton 44 in position to be engaged by the rear end of the tailpiece when the head of the latch bolt is fully retracted.

An inside knob hub 46 and an outside knob hub 48 are mounted coaxially in bearing holes 50 and 52 in the front and rear walls of the case. Each hub has an axial square hole 54 to receive the end of a knob spindle 56 for connecting its associated knob 16 or 18 to rotate the hub 46 or 48.

The outside knob hub 48 carries a flange 58 having a notch 60 into which a stop plate 62 is projected when the upper of the two stopwork buttons 20 is depressed, so as to lock the outside knob hub 48 against rotation. Depression of the lower button 21 releases the outside hub for rotation by its knob 18. The inside knob hub is cut away in the vicinity of such stopwork plate 62 so that it is freely rotatable under all conditions.

As shown in FIG. 2, the inside knob hub 46 comprises a cam flange 66 formed with a section of a heart cam surface which includes a central valley 68 and laterally extending surfaces 70 and 72 which spiral outward in opposite directions from such valley 68. Preferably, the cam faces merge smoothly with each other at their points of tangency. The flange 58 of the outside knob hub 48 is shaped with a cam surface identical with that of the inside knob hub, and includes a valley 68, partially shown in FIG. 3, and opposite outward-spiralling faces like the faces 70 and 72 of the inside knob hub and in alignment therewith.

A retraction lever 76 is pivotally mounted on a pivot pin 78 extending between the back and front walls of the case and extends therefrom upward and forward past the hubs 46 and 48 and is formed at its upper end with a nose 80 which lies between the tailpiece 34 and the back wall 28 of the case and in engagement with the tail plate 38 of the latch bolt 14. A downward extending second lever nose 82 may lie between the tailpiece 34 and the front wall of the case to actuate the latch bolt from the key-actuated mechanism 26 which is not relevant to the present invention and not shown. The retraction lever 76 is formed at an intermediate point in its length with a thick portion 77 which carries spaced side walls 84 and 86. These form a yoke in which a roller 88 is mounted by means of a relatively small pin or shaft 90. The roller is adapted to seat in the valleys 68 of the cam flanges 58 and 66 of the two hubs 46 and 48, and to serve as a cam follower of the cam surfaces 70 and 72 on such flanges. The retraction lever is biased toward the hubs by a biasing spring 92.

Figure 4:
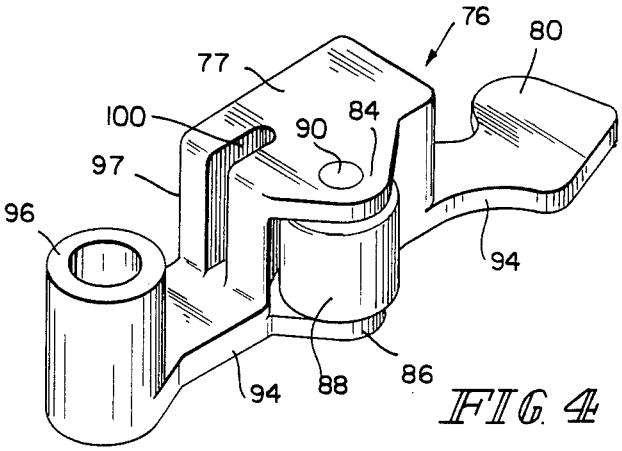
FIG. 4 is a perspective view of the retraction lever shown in FIGS. 2 and 3.

The retraction lever 76 is preferably formed as a one-piece molded part of the configuration shown in FIG. 4, and is conveniently made as a pressed and sintered powdered metal part. Such lever 76 comprises a generally flat bar portion 94 adapted to ride along the surface of the back wall 28 of the case. At the pivoted end of the lever, the bar portion 94 is integrally joined to a pivot hub 96 adapted to be rotatably mounted on the pivot pin 78. The opposite end of the bar portion 94 carries the lever nose 80. The intermediate thick portion 77 of the lever lies in relatively close clearance relation with the opposite front and back walls 28 and 30 of the case, and the spaced side walls 84 and 86 project from such portion to form the yoke in which the roller 88 is mounted by means of a relatively small pin 90. To reduce friction, the pin 90 is fitted with a rotatable clearance both in the roller 80 and in through holes in the side walls 84 and 86 of the yoke. In operating assembled condition, the side walls of the yoke ride in close clearance relation with the side walls of the case, and the pin is trapped in place by those side walls 28 and 30. Desirably, the thick portion 77 of the lever is formed with a slot 100 for the reception of one leg of the lever-biasing spring 92.

The stopworks bar 62 has ears at its edges which ride in slots in the front and rear walls of the case, and such bar extends forward and is fixed to the upper stopworks button 20 so that it will be moved into engagement with the slot 60 when that button is depressed. The lower stopworks button 21 is fixed to the forward end of a second bar 63 and the two bars are connected for opposite movement by a butterfly lever 65, the lower end of which is engaged with an overcenter spring 67. The lower stopworks button 21 is thus operative to retract the stopworks bar 62 from the notch 60 when such button is depressed, as shown in FIG. 2.

The latch-retraction mechanism operates as follows. The retraction lever 76 is biased toward the coaxial inside and hubs 46 and 48 so that the roller 88 rests in the valleys 68 of the cam flanges of those hubs. The hubs are thus held in a normal position, and the latch bolt 14 is biased to its projected position by its biasing spring 38. With the stopworks bar 62 withdrawn, as shown in FIG. 2, either knob 16 or 18 may be rotated in either direction to retract the bolt. If, for example, the inside knob 16 is rotated counterclockwise from the position shown in FIG. 2, the inside hub 46 is rotated to carry the cam surface 72 against the roller 88 and to force the lever 76 to pivot rearward so that its nose 80 forces the tail plate 38 and the tailpiece of the latch bolt 14 to a retracted position. In the fully retracted position of the latch bolt, the flat back face 97 of the lever 76 moves against the rear edge wall 29 of the case so that such wall acts as a stop for the lever. This carries the lever 76 to the position shown in dotted lines.

In the action of the cam surface 72 in camming the lever to its retracted position, the camming force is exerted in a primarily rearward but somewhat downward direction on the roller 88. Such force is transmitted to the lever through the relatively small pin 90, and generates a component of force normal to the lever arm from the pivot pin 78 to the roller shaft 90, and originating at a point on the surface of such pin 90. Similarly, if the knob is rotated in the opposite direction, the cam surface 70 on the cam flange of the inside knob hub 46 will act against the roller 88 to pivot the lever 76 to its retracted position. In this case, the camming force is transmitted to the roller 88 in a primarily rearward but somewhat upward direction rather than a rearward and downward direction as in the case of the cam face 72. As with the cam face 72, however, the force will be transmitted to the lever through the relatively small pin 90 and will generate a component of force normal to substantially the same lever arm from the pivot pin 78 to the small pin 90, and originating at the surface of that small shaft. Whether the knob is rotated clockwise or counterclockwise, the effective lever arms will be substantially the same. Also, the camming action of the opposite camming surfaces 70 and 72 will be substantially the same for the same degree of rotation of the knob and knob hub. Accordingly, with similar degrees of rotation required and similar lengths of lever arm, the torque required for retraction of the latch bolt 14 will be substantially the same whether the knob is turned in one direction or the other. Moreover, because of the roller action and a minimum of sliding movement between the parts, the frictional load opposing the latch-retracting movement will be low. The invention thus provides both that the latch bolt can be retracted with relatively low torque applied to the knobs and that such torque will be substantially the same whether the knob is rotated clockwise or counterclockwise.

While the operation has been described in connection with the inside knob and inside knob hub 46, the same identical action occurs with the outside knob hub 48 the cam faces of which act on the same roller 88 in the same way as described.

What is claimed is:

1. A mortise lock comprising a case having front and back side walls and an edge face, a latch bolt including a tailpiece, support means for slidably mounting the latch bolt between the side walls, a knob hub having a cam flange, means for rotatably mounting the knob hub in the case for operation by a handle or knob, a retraction lever for retracting the latch bolt, the retraction lever comprising a nose portion in engagement with the tailpiece to define a tailpiece contact point, a pivot portion pivotally mounted on a pivot in the case, and a mid-portion intermediate the nose and pivot portions including spaced-apart side walls defining a yoke open toward the cam flange, and cam follower means for riding on the cam flange during rotation of the hub so that the retraction lever is pivoted rearward about the pivot in the case to retract the tailpiece in response to rotation of the knob hub, the cam follower means including a roller and shaft means for rotatably supporting the roller in the yoke to engage the cam flange to define a hub contact point, the hub contact point changing position on the cam flange in response to rotation of the knob hub, the tailpiece and hub contact points cooperating to define an effective lever arm of substantially constant dimension therebetween irrespective of the direction of hub rotation.

2. The mortise lock of claim 1, wherein the knob hub includes inside and outside hub members rotatably mounted in the case in coaxial relation and operable respectively by inside and outside handles or knobs, the two hub members each having a cam flange thereon formed with a central cam valley and opposite spiral cam faces, and the roller normally engages the cam valleys on both hub members and rides on the cam faces on both hub members during rotation thereof.

3. The mortise lock of claim 1, wherein the opposite cam faces are generally symmetrical with respect to a line through the axes of the roller and the hub.

4. The mortise lock of claim 1, wherein the spaced yoke walls have free-sliding clearance between said side walls, and said roller shaft has a rotating fit both in said roller and through holes in said yoke walls and is trapped therein between the side walls of the case.

5. The mortise lock of claim 1, wherein the retraction lever includes a generally flat bar portion extending adjacent one side wall of the case.

6. A mortise lock comprising a case, a latch bolt including a tailpiece, a retraction lever for retracting the latch bolt, the ratraction lever including a nose portion in engagement with the tailpiece to define a tailpiece contact point, a pivot portion pivotally mounted on a pivot in the case, and a mid-portion intermediate the nose and pivot portions including spaced-apart side walls defining a yoke, inside and outside operating hubs mounted in the case for independent rotation and aligned in coaxial relation, each operating hub being rotatable in at least one direction toward a rotated position and formed to include a hub camming surface, cam follower means for riding on the hub camming surfaces during rotation of the hubs to cause the retraction lever to pivot and retract the latch bolt in response to rotation of one of the inside and outside operating hubs, the cam follower means including a roller and shaft means for rotatably supporting the roller in the yoke to engage the hub camming surface to define a movable hub contact point thereby causing the tailpiece contact point and the movable hub contact point to cooperate to define a single effective lever arm extending therebetween irrespective of the direction of hub rotation.

7. The mortise lock of claim 6, wherein each hub camming surface includes a central cam valley and opposite cam faces spiralling outward from the valley in opposite directions, and the opposite cam faces are generally symmetrical with respect to a line through the axes of the roller and the coaxial hubs.

8. A mortise lock comprising a case having front and back side walls and an edge face, a latch bolt including a tailpiece, and support means for slidably mounting the latch bolt between the side walls, inside and outside hubs, each hub having a cam flange thereon formed with a central cam valley and opposite cam faces spiralling outward from the valley in opposite directions, and means for rotatably mounting the inside and outside hubs in the case in coaxial relation so that the inside and outside hubs are operable respectively by inside and outside handles or knobs, a retraction lever for retracting the latch bolt, the retraction lever including a generally flat bar portion extending adjacent one side wall of the case and having a nose lying between such wall and the tailpiece of the bolt, a pivot hub integral with the opposite end of the bar portion and projecting therefrom substantially to the opposite side wall of the case, and a thick mid-portion on the lever extending substantially to the opposite side wall and including axially spaced walls, the bar portion and the axially spaced walls cooperating to define a yoke, means for pivotally mounting the pivot hub of the retraction lever in the case, and cam follower means for riding on the cam flange during rotation of a selected hub, the cam follower means including a roller and shaft means for rotatably supporting the roller in the yoke to engage normally the cam valley of the cam flange of both the inside and ouside hubs, the cam faces being operable to cam the roller in a direction to pivot the retraction lever rearward to retract the tailpiece so that the force exerted on the retraction lever by the roller is transmitted to the tailpiece through the shaft means so as to be exerted at substantially the same point along the length of the retraction lever in response to rotation of one of the inside and outside hubs in either direction.

9. The mortise lock of claim 8, wherein the opposite cam faces of each of the inside and outside hubs are generally symmetrical with respect to a line through the axes of the roller and the coaxial hubs.

10. The mortise lock of claim 8, wherein said spaced yoke walls have free-sliding clearance between said side walls and the shaft means has a rotating fit both in the roller and in through holes in the yoke walls and is trapped therein between the side walls of the case.

* * * * *